US005734339A

United States Patent [19]

Ogle

[11] Patent Number: 5,734,339

[45] **Date of Patent: *Mar. 31, 1998**

[54] CROSSWALK WARNING LIGHT SYSTEM

[76] Inventor: Terry B. Ogle, 1341 Dolly Parton Pkwy., Sevierville, Tenn. 37862

[ * ] Notice: The term of this patent shall not extend beyond the expiration date of Pat. No. 5,406,276.

[21] Appl. No.: 710,751

[22] Filed: Sep. 20, 1996

[51] Int. Cl.[6] ..... G08G 1/095

[52] U.S. Cl. ..... 340/944; 340/925; 340/557; 340/691; 116/63 R

[58] Field of Search ..... 340/944, 908, 340/908.1, 925, 555, 557, 691; 116/63 R; 362/800

[56] References Cited

U.S. PATENT DOCUMENTS

| | | | |
|---|---|---|---|
| 2,700,754 | 1/1955 | McCullough | 340/116 |
| 3,199,073 | 8/1965 | Hilliker | 340/36 |
| 4,025,922 | 5/1977 | Trawick, III | 343/6.5 LC |
| 4,570,207 | 2/1986 | Takahashi et al. | 362/152 |
| 4,590,474 | 5/1986 | Patterson et al. | 340/944 |
| 5,103,223 | 4/1992 | Humphrey | 340/944 |
| 5,406,276 | 4/1995 | Ogle | 340/944 |
| 5,519,390 | 5/1996 | Casini | 340/929 |
| 5,559,509 | 9/1996 | Ogle | 340/944 |
| 5,572,202 | 11/1996 | Regel et al. | 340/917 |

FOREIGN PATENT DOCUMENTS

| | | |
|---|---|---|
| 712131 | 9/1931 | France . |
| 8700326 | 1/1987 | France . |
| 3407929 | 9/1985 | Germany . |

*Primary Examiner*—Jeffery Hofsass
*Assistant Examiner*—Anh La
*Attorney, Agent, or Firm*—Pitts & Brittian, P.C.

[57] ABSTRACT

A crosswalk warning light system for warning drivers that a pedestrian has entered a crosswalk by shining a light onto the crosswalk and any pedestrians in the crosswalk. The crosswalk warning light system detects a pedestrian entering the crosswalk and activates the light so that a driver can see and avoid the pedestrian in the crosswalk. The crosswalk warning light system is timed so as to deactivate the light after a predetermined interval of time. The light source is selected from any conventional light source such as a scanning laser, a focused strobe light, or a focused incandescent light. The light source is supported above the crosswalk and aimed down toward the crosswalk so that the entire area defined by the crosswalk is illuminated. Further, by aiming the light source down on the crosswalk, the pedestrians are also illuminated.

19 Claims, 5 Drawing Sheets

CROSSWALK WARNING LIGHT SYSTEM

This application in part discloses and claims subject matter disclosed in my earlier filed pending application, Ser. No. 08/369,902, filed on Jan. 9, 1995, which is to issue on Sep. 24, 1996 as U.S. Pat. No. 5,559,509, which disclosed and claimed subject matter disclosed in my earlier filed application, Ser. No. 07/911,080, filed on Jul. 9, 1992, which issued as U. S. Pat. No. 5,406,276.

TECHNICAL FIELD

This invention relates to the field of crosswalk warning lights. More specifically, it relates to a light system for warning drivers that a pedestrian is in an intersection or non-intersection crosswalk.

BACKGROUND ART

Pedestrian traffic as well as automobile traffic makes use of intersections in urban and suburban streets. As pedestrians travel from one location to another in a developed area, they are inevitably faced with walking across a street. In order to assist the pedestrians in crossing safely, the familiar "WALK", "DON'T WALK" or the analogous iconographic signs are linked to standard motor-traffic controls. While these controls warn pedestrian traffic of the safest opportunity to cross the intersection, they do not prevent a pedestrian from entering an intersection when oncoming traffic has the right of way.

Also many urban areas and resort areas that have an especially heavy flow of pedestrian traffic have non-intersection crosswalks, i.e. crosswalks between intersections in which pedestrians always have the right of way. There are presently no warning light systems that warn oncoming traffic that a pedestrian is attempting to cross against the light or has entered a non-intersection crosswalk and is presently in the crosswalk. This need is most acute during periods of poor visibility when an alert driver would experience difficulty in spotting pedestrians.

Accordingly, it is an object of this invention to provide a crosswalk warning light system that is able to detect when a pedestrian has entered a crosswalk and accordingly activate a light or light system that warns drivers of oncoming traffic of the presence of a pedestrian in the crosswalk.

It is another object of this invention to provide a crosswalk warning light system that provides warning lights that are highly visible to oncoming traffic during periods of poor visibility, such as fog or inclement weather.

A further object of the present invention is to provide a crosswalk warning light system that illuminates a crosswalk area, including the pedestrians within the crosswalk area.

Other objects and advantages over the prior art will become apparent to those skilled in the art upon reading the detailed description together with the drawings as described as follows.

DISCLOSURE OF THE INVENTION

In accordance with the various features of this invention, a crosswalk warning light system is provided. The crosswalk warning light system detects a pedestrian entering the crosswalk and activates a light that is aimed across the street in order to project a beam of light from one end of the crosswalk to the other, thus the driver sees this beam of light and is warned of the presence of a pedestrian in the crosswalk. The light source is any of a laser, a strobe light, incandescent light, or other conventional light. The light system is timed so as to deactivate the light source after a predetermined interval of time. In the preferred embodiment, two light sources, which are spaced apart a distance substantially the width of the crosswalk, provide parallel beams of light on each side of the crosswalk. Also in the preferred embodiment, a second light source, disposed at the opposite end of the crosswalk, provides a second beam of light, aimed substantially co-linearly with the first. This allows at least a partial beam of light at each end of the crosswalk in the event a pedestrian blocks the first beam of light. Also in the preferred embodiment, a pulsed yellow "caution" light beam immediately precedes a continuous red "stop" beam.

In a further embodiment, at least one scanner utilizing a focused beam of light, such as a laser, strobe light, or other conventional light source, is disposed above the crosswalk and illuminates the crosswalk area. In the event that a laser is used, the laser illuminates the crosswalk area by rapidly scanning the focused beam of light in a predetermined pattern such that light reflected from a pedestrian is seen by an approaching driver. In the event a strobe light is used, the strobe light is focused such that the light emitted therefrom is directed to illuminate the crosswalk.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
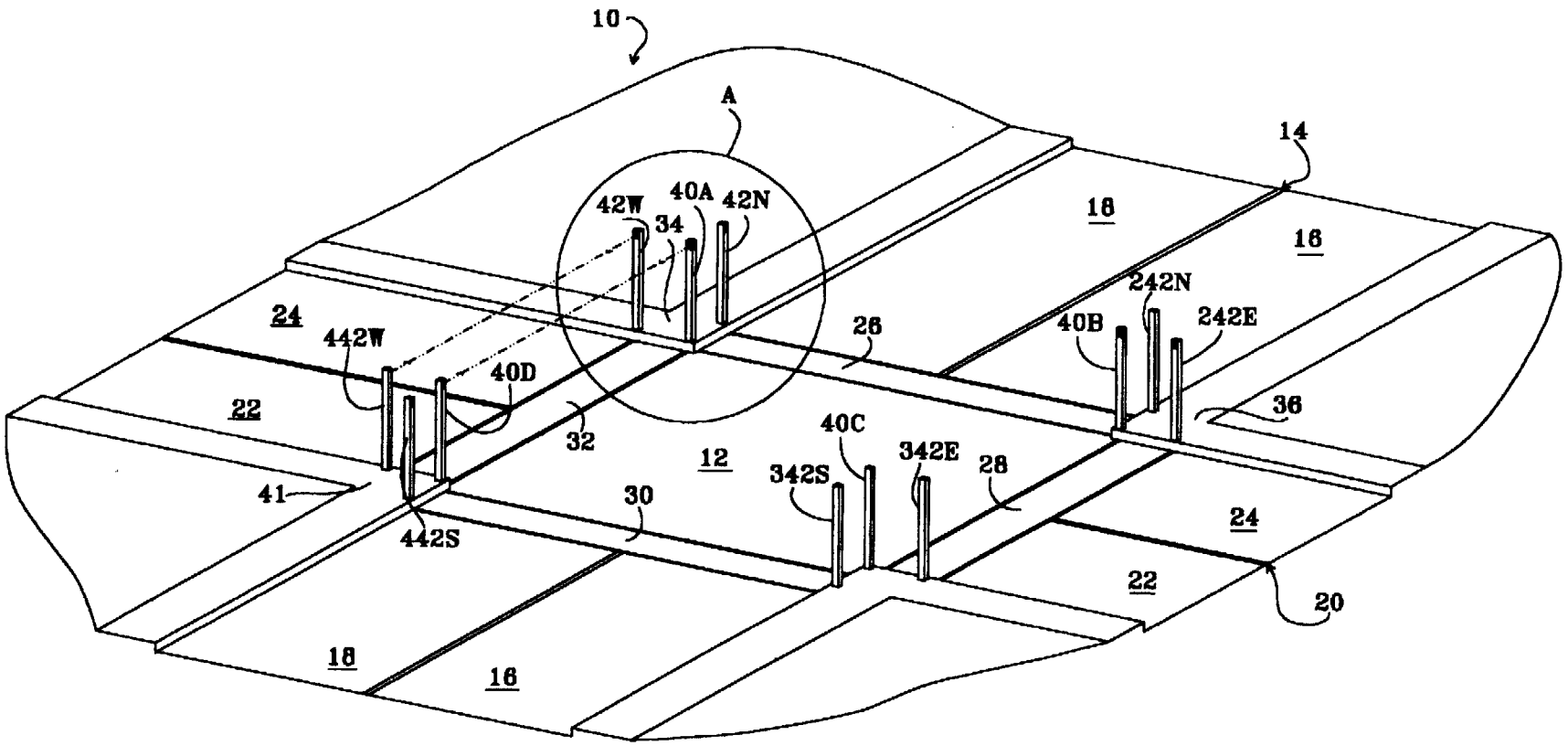
FIG. 1 illustrates a perspective view of an intersection equipped with the crosswalk warning light system of the present invention.

A crosswalk warning light system constructed in accordance with the present invention is illustrated generally as 10 in the figures. For convenience and ease of illustration, the crosswalk warning light system is shown on an intersection 12 which consists of the junction of a first street 14, having a north bound lane 16 and a south bound lane 18, and a second street 20, having an east bound lane 22 and a west bound lane 24. To facilitate pedestrian traffic, intersection 12 also has a northern cross-walk 26, an eastern crosswalk 28, a southern crosswalk 30 and a western crosswalk 32. Northern crosswalk 26 extends from northwestern corner 34 to northeastern corner 36. Likewise western crosswalk 32 extends from northwestern corner 34 to southwestern corner 41. It will be understood that references to direction are not intended to limit the disclosure, but are for ease of illustration. It will be further understood that intersection 12 could be equipped with standard traffic controls, such as the familiar red-yellow-green traffic lights (not shown) and could also be equipped with typical pedestrian controls, such as either the familiar "WALK"- "DON'T WALK" or analogous iconographic signs (not shown).

Figure 2:
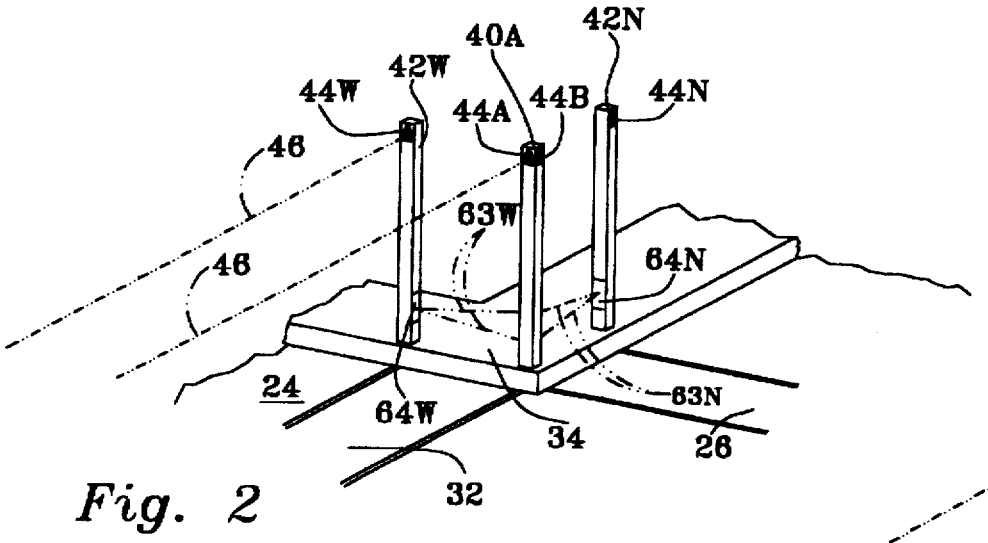
FIG. 2 illustrates an enlarged perspective view thereof facing the sidewalk at a street corner as illustrated at circle A of FIG. 1.
Figure 3:
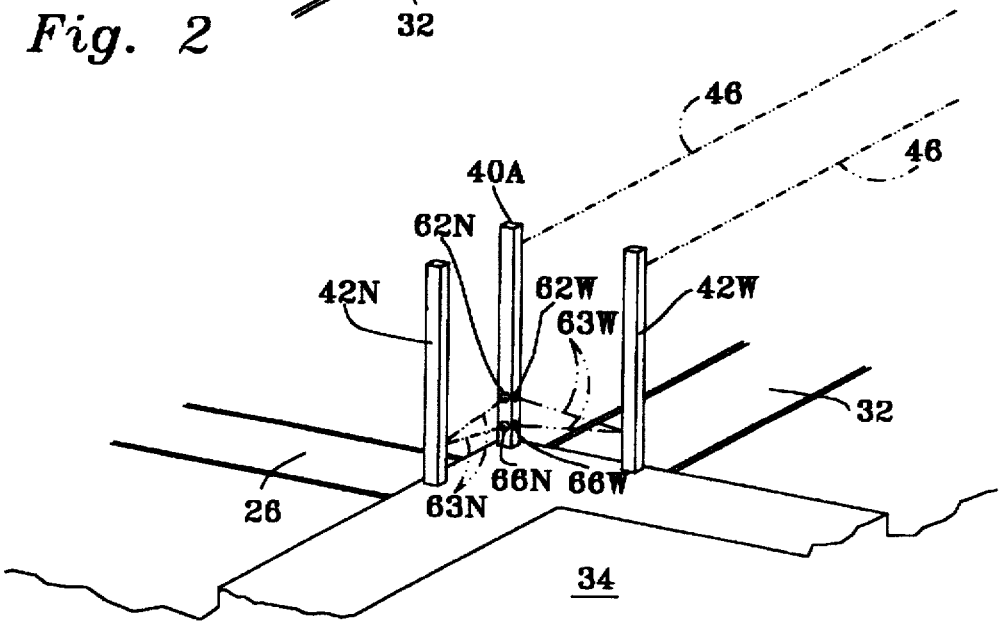
FIG. 3 illustrates an enlarged perspective view thereof facing away from the sidewalk at a street corner as illustrated at circle A of FIG. 1.

As a pedestrian enters a crosswalk, a light emitter 44, such as a laser, strobe, flood, or other conventional light emitter, emits a coherent beam of light 46 across the crosswalk so as to be visible to oncoming traffic. Also in the preferred embodiment, the light emitter 44 emits a pulsatile yellow "caution" beam immediately followed by a red "stop" beam. The light emitter 44 is carried by a support pole 40, which is disposed at each corner. As can be seen in FIG. 2 and 3, the support pole 40A is located on the northwest corner 34. The support pole 40A carries a light emitter 44A, which is associated with western crosswalk 32, and emitter 44B, which is associated with northern crosswalk 26. It will be understood that support poles 40B, 40C and 40D also carry two emitters 44 in like fashion. Preferably, each light emitter 44 carried by support poles 40A, 40B, 40C and 40D is aimed co-linearly with the other light emitter 44 associated with the same crosswalk, thus forming opposing pairs of light emitters 44 associated with each crosswalk.

In the preferred embodiment, the support pole 42N is disposed a distance approximately equal the width of the northern crosswalk 26, to the north of support pole 40A. Support pole 42N also carries a light emitter 44 which is associated with northern crosswalk 26. Support pole 42W is disposed a distance approximately the width of the western crosswalk 32, to the west of support pole 40A. In the preferred embodiment, support pole 42W also carries a light emitter 44 which is associated with western crosswalk 32. While a specific support pole has been illustrated in the figures, it will be understood by those skilled in the art that a light emitter 44 may be carried by an existing pole such as is used to carry any existing traffic/pedestrian control.

Figure 6:
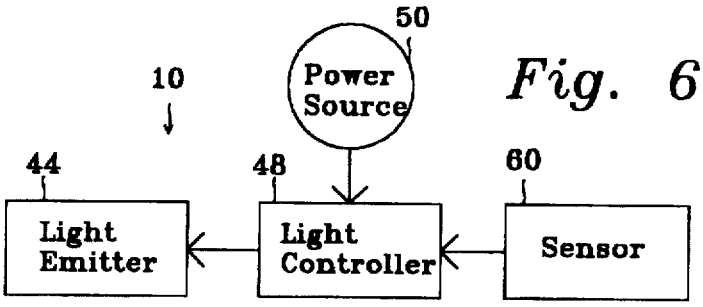
FIG. 6 illustrates a schematic of the crosswalk warning light system of the present invention.

In FIG. 6, a block diagram is shown in which the light emitter 44 is controlled by a light controller 48, which receives signals from a sensor 60. The system 10 is energized by a power source 50. It will be recognized by those skilled in the art that the power source 50 may be hardwired to the same power source as existing traffic controls, hardwired directly to main power leads, battery-powered or solar-powered.

The sensor 60 is of a conventional type, such as a pressure-sensitive pad such as is used by some automatic doors or a manual push-button type device activated by the pedestrian. In the illustrated embodiment, the sensor 60 is an infrared detector including an infrared light (IR) source 62, a reflector 64 and an IR detector 66. The IR source 62 and detector 66 are positioned with respect to each other one one side of the particular crosswalk, with the reflector 64 positioned at the opposite side of the crosswalk, such that an IR beam 63 is directed across the crosswalk to the reflector 64, and back to the detector 66. When the IR beam 63 is broken, such as by the entrance of a pedestrian in the crosswalk, the IR detector 66 senses the absence of the IR light and thus indicates the presence of the pedestrian in the crosswalk.

Reference is made to FIGS. 2 and 3 which illustrate an enlarged view of a typical corner, such as the northwest corner 34. It will be understood that the configuration illustrated in FIGS. 2 and 3 and described below is, similarly, installed on the other respective corners, as is illustrated in FIG. 1. In the preferred embodiment, IR sources 62N and 62W are mounted a small distance, i.e. approximately 12–18 inches, above the ground on support pole 40. The IR source 62N is focused toward the reflector 64N, which is carried by the support pole 42N. Likewise, the IR source 62W is focused toward the reflector 64W, which is carried by the support pole 42W. The IR source 62N emits an IR beam 63N, which is then reflected by reflector 64N toward the IR detector 66N. As a pedestrian steps into the northern crosswalk 26, the IR beam 63N is momentarily broken. This causes the sensor 60 to generate a signal which in turn causes the light controller 48 to activate the light emitters 44B,44N. Similarly, if a pedestrian steps into the western crosswalk 32, the IR beam 63W is momentarily broken. This causes the sensor 60 to generate a signal which in turn causes the light controller 48 to activate the light emitter 44A and, in the preferred embodiment, 44W.

In a preferred embodiment, the light controller 48 also activates the light emitter 44 carried by support pole 40D that is associated with western crosswalk 32 and the light emitter 44 carried by support pole 442W simultaneously with the light emitters 44A and 44W. Thus in the most preferred embodiment, opposing light emitters 44—i.e. light emitters 44 aimed co-linearly and are associated with the same crosswalk—are activated simultaneously. This arrangement substantially prevents a light beam from being blocked by a pedestrian stepping in its path.

Figure 7:
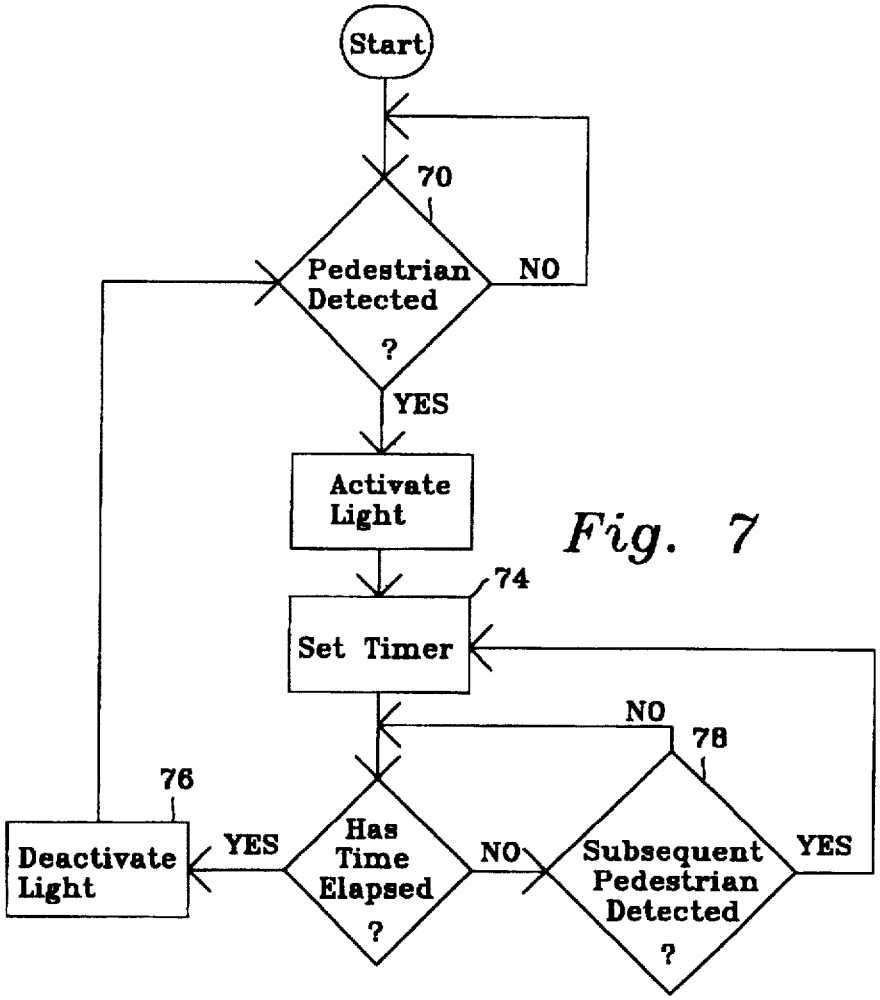
FIG. 7 a flow chart illustrating the operation of the controller of the warning light system of the present invention.

In addition to activating the various light emitters 44, the light controller 48 also deactivates the light emitters 44 after a predetermined amount of time. In FIG. 7, a flow diagram illustrates the operation of the light controller 48. If a pedestrian is detected, as illustrated by decision box 70, by the sensor 60, then the light controller 48 activates the appropriate light emitters 44 and sets a timer, as denoted at 74. If the predetermined amount of time elapses prior to a subsequent pedestrian being detected, then the light emitter is deactivated 76. However, if a subsequent pedestrian is detected entering the crosswalk, as illustrated at decision box 78, the timer is re-set at 74. In this fashion, the light controller 48 does not deactivate a light emitter while a pedestrian is in the crosswalk.

Figure 4:
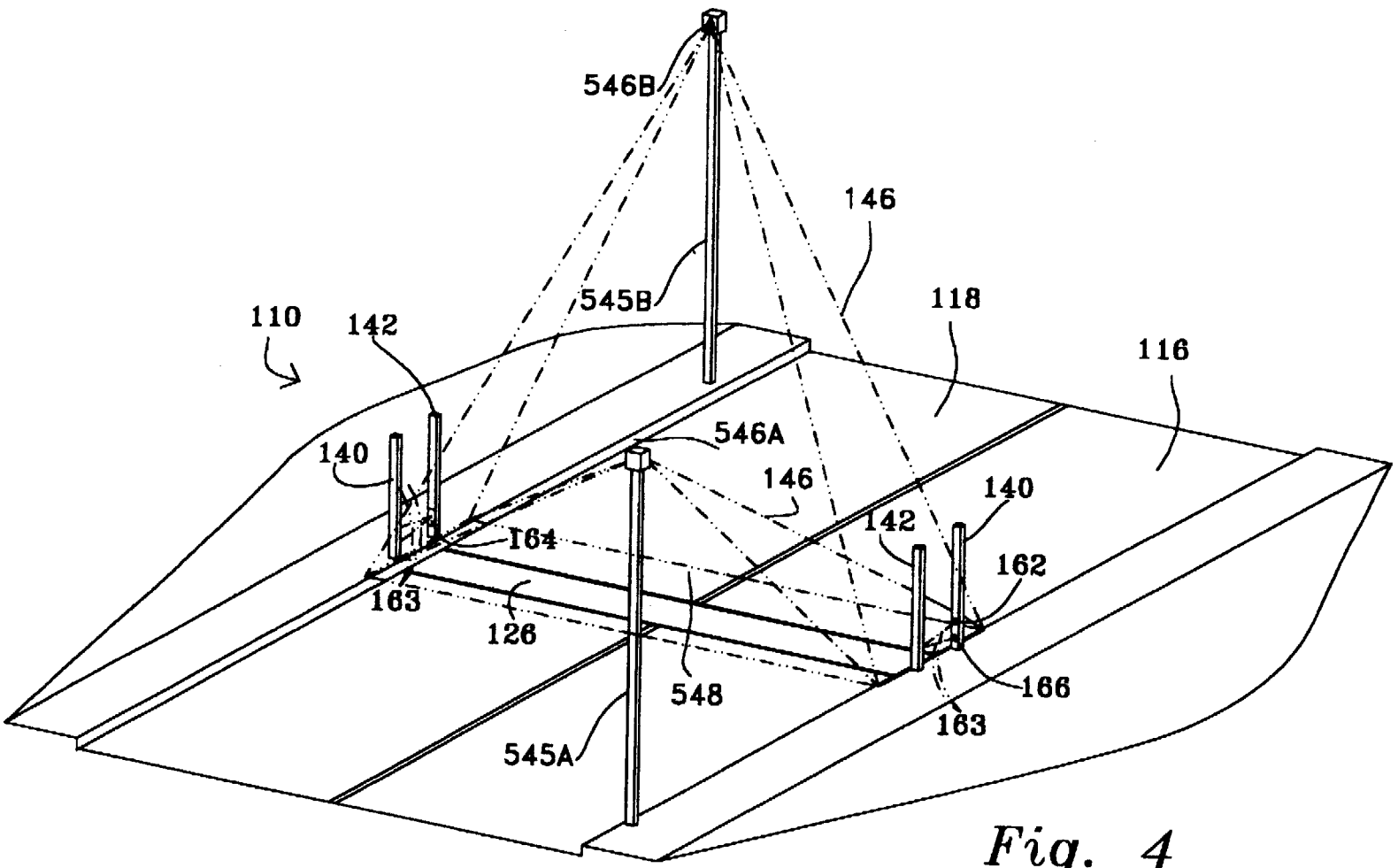
FIG. 4 illustrates a perspective view of an alternate embodiment of the crosswalk warning light system at a non-intersection crosswalk.

An alternate embodiment of the present invention is illustrated in FIG. 4, in which crosswalk warning light system 110 utilizes a light source 546 positioned above and directed toward the street proximate the crosswalk. While system 110 is illustrated at a non-intersection crosswalk, those skilled in the art will recognize that system 110 may be utilized at any crosswalk. Those skilled in the art will also recognize that system 110 may also be utilized at a railroad crossing either in conjunction with or as a replacement of the traditional cross-bar, and that further, either system 10 or system 110 may be adapted to be a portable system. In system 110, an IR source 162, an IR beam 163, a reflector 164 and an IR, detector 166 each function in the same manner as the IR, source 62, the IR beam 63, the reflector 64, and the IR detector 66, respectively, described above and illustrated in FIGS. 1–3.

System 110 utilizes a light source 546 which is supported by the upper end of a light support 545. While a pole is illustrated, those skilled in the art will recognize that the light source 546 may be supported by other state of the art means such as a cantilevered horizontal support (not shown) or a cable such as cable 550 shown in FIG. 5. In the preferred embodiment for system 110, a light support 545 is positioned on either side of the street. The IR source 162 emits an IR beam 163, which is then reflected by the reflector 164 toward the IR detector 166. As a pedestrian steps into crosswalk 126, the IR beam 163 is momentarily broken. The sensor 60 then generates a signal which activates the light source 546. The light source 546 illuminates an area 548 including at least the crosswalk area defined by the opposing sides and opposite ends of the crosswalk 126. It will be recognized that the light source 546 may be any conventional light source such as a scanning laser, a focused strobe light, a focused incandescent light, or any other collimated beam or coherent beam of light. Thus, a pedestrian in the area 548 will be illuminated by the light source 546 and will be visible to oncoming traffic.

In the preferred embodiment of the system 110, the area 548 extends the entire length of crosswalk 126 so that a driver will be able to see pedestrians in the driver's lane as well as pedestrians about to enter that lane. Further, the area 548 is wider than crosswalk 126 in order to account for the height of pedestrians near the boundary of crosswalk 126.

In the preferred embodiment of the system 110, the area 548 is illuminated from both directions of traffic. However, those skilled in the art will recognize that a single light support 545 and light source 546 may be utilized. It will also be recognized by those skilled in the art, that in systems 110 using a plurality of light sources 546, separate light sources 546 may illuminate smaller areas than the area 548, but which combine to illuminate the entire area 548. As in the first embodiment, the light controller 48 deactivates the light source 546 after a predetermined amount of time.

Figure 5:
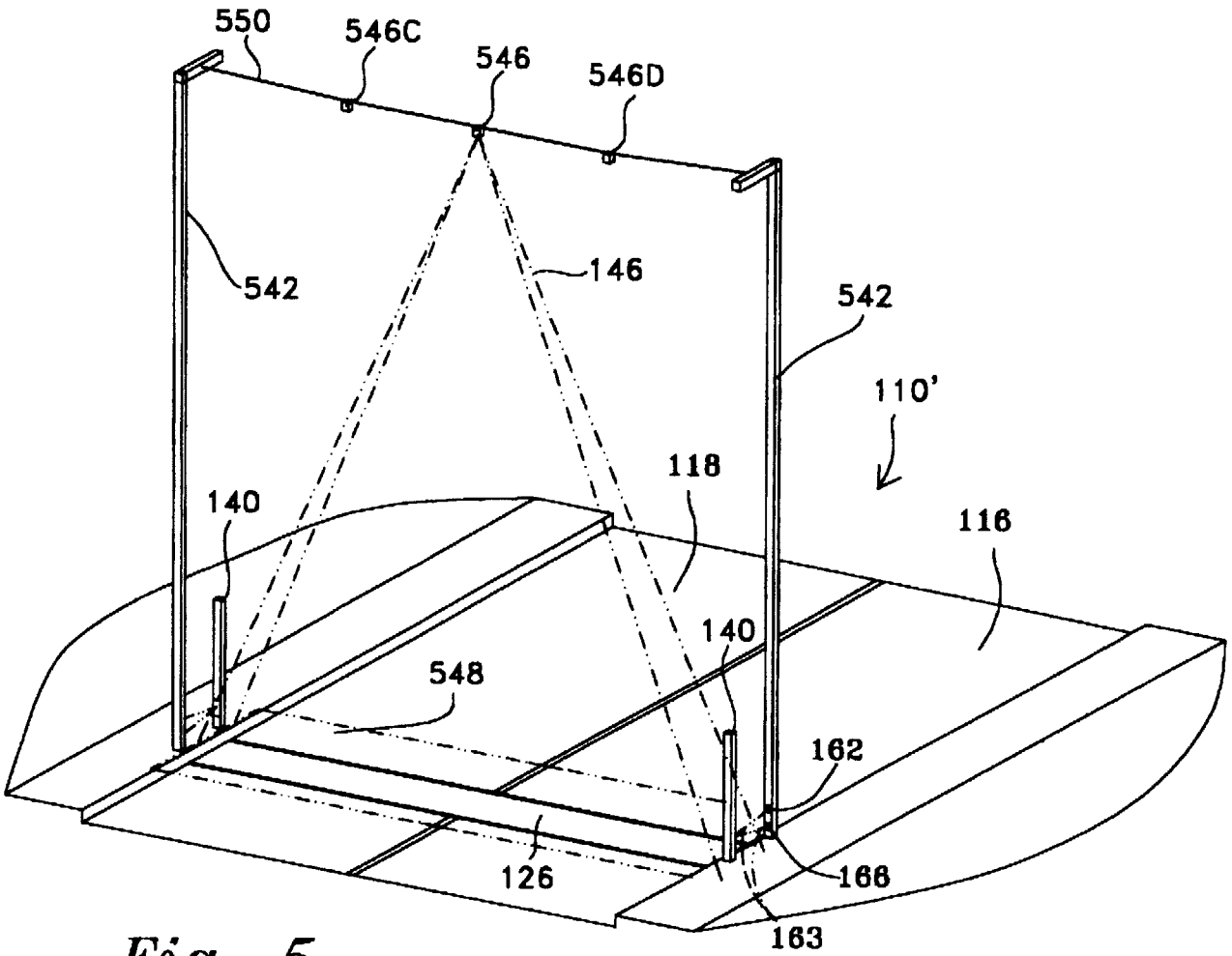
FIG. 5 illustrates perspective view of a further alternate embodiment of the crosswalk warning light system utilizing an overhead scanning beam of the present invention installed at a non-intersection crosswalk.

An alternate embodiment of system 110 is designated 110' in FIG. 5. In system 110', support poles 542 are in spaced relation to one another and are configured so as to suspend the light source 546, preferably by means of a cable 550, directly above the crosswalk 126. It will be recognized by those skilled in the art that the light source 546 may be suspended directly above crosswalk 126 by other state of the art means such as a cantilevered horizontal support (not shown). In appropriate situations, more than one light source 546, 546C, and 546D may be utilized in spaced relation to each other. Those skilled in the art will readily recognize that scanning laser 546, in either system 110 or system 110', is dependent upon a power supply such as power supply 50.

Figure 8:
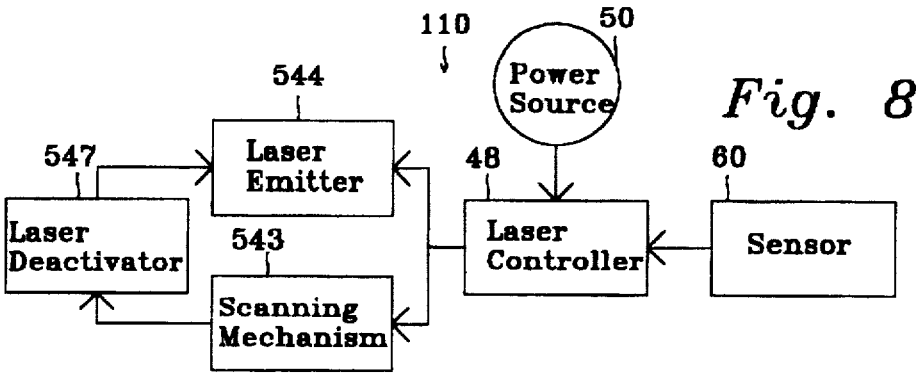
FIG. 8 illustrates a schematic of an alternate embodiment of the crosswalk warning light system illustrated in FIG. 6.

Those skilled in the art recognize when the light source 546 is a scanning laser, the light source 546 consists of a laser source 544 in conjunction with a scanning mechanism 543, as illustrated schematically in FIG. 8. As described above, the laser controller 48', receives signals from the sensor 60 and in turn activates the scanning mechanism 543 and the laser source 544. Systems 110 and 110' are each energized by the power source 50. In order to prevent the laser source 544 from being activated when the scanning mechanism 543 is inactive, the laser deactivator 547 deactivates the laser source 544 only if the scanning mechanism 543 ceases scanning. In this regard the laser deactivator 547 is state of the art electronic circuitry or processing circuitry.

From the foregoing description, it will be recognized by those skilled in the art that a crosswalk warning light system offering advantages over the prior art has been provided. Specifically, the crosswalk warning light system provides a system that is able to detect when a pedestrian has entered the crosswalk and accordingly activate lights that warn oncoming traffic of the presence of a pedestrian in the crosswalk and also provides warning lights that are highly visible to oncoming traffic during periods of poor visibility, such as fog or inclement weather.

While a preferred and alternate embodiments have been shown and described, it will be understood that they are not intended to limit the disclosure, but rather the disclosure is intended to cover all modifications and alternate methods falling within the spirit and the scope of the invention as defined in the appended claims.

Having thus described the aforementioned invention, I claim:

1. A crosswalk warning light system for giving visual indication to motor traffic on a selected road that at least one pedestrian is within a crosswalk crossing the selected road by illuminating the crosswalk and objects therein, the crosswalk terminating at first and second ends on either side of the road and defining first and second side boundaries, said crosswalk warning light system comprising:

a power supply;

a first light source vertically spaced from the ground for illuminating at least a portion of the crosswalk with a first portion of said visual indication, said illuminated portion defining an illumination area including at least an area defined by the crosswalk;

a first light support for supporting at least said first light source above the crosswalk;

at least one sensor for detecting a pedestrian entering the crosswalk at either of the first and second ends of the crosswalk; and a controller for activating and deactivating said first light source, said controller activating said first light source upon detection by said sensor the pedestrian entering the crosswalk.

2. The crosswalk warning light system of claim 1 further comprising:

a second light source vertically spaced from the ground for illuminating at least a portion of said illumination area with a second portion of said visual indication; and a second light support for supporting said second light source above the crosswalk.

3. The crosswalk warning light system of claim 1 wherein said first light source is positioned in spaced relation from the crosswalk such that said first portion of said visual indication is projected into the crosswalk in the direction of traffic flow.

4. The crosswalk warning light system of claim 2 wherein said second light source is positioned in spaced relation from the crosswalk such that said second portion of said visual indication is projected into the crosswalk in the direction of traffic flow.

5. The crosswalk warning light system of claim 1 wherein said first light source is positioned directly above said crosswalk.

6. The crosswalk warning light system of claim 2 wherein each of said first light source and said second light source is a scanning laser.

7. The crosswalk warning light system of claim 2 wherein each of said first light source and said second light source is a focused strobe light.

8. A crosswalk warning light system for giving visual indication to motor traffic on a selected road that at least one pedestrian is within a crosswalk crossing the selected road by illuminating the crosswalk and objects therein, the crosswalk terminating at first and second ends on either side of the road and defining first and second side boundaries, said crosswalk warning light system comprising:

a power supply;

a first light source vertically spaced from the ground for illuminating at least a portion of the crosswalk with a first portion of said visual indication, said illuminated portion defining an illumination area including at least an area defined by the crosswalk;

a second light source vertically spaced from the ground for illuminating at least a portion of said illumination area with a second portion of said visual indication;

a light support for supporting at least one of said first light source and said second light source above the crosswalk;

at least one sensor for detecting a pedestrian entering the crosswalk at either of the first and second ends of the crosswalk; and a controller for activating and deactivating said first light source, said controller activating said first light source upon detection by said sensor of the pedestrian entering the crosswalk.

9. The crosswalk warning light system of claim 8 further comprising a second light support for supporting one of said first light source and said second light source above the crosswalk.

10. The crosswalk warning light system of claim 8 wherein said first light source is positioned in spaced relation from the crosswalk such that said first portion of said visual indication is projected into the crosswalk in the direction of traffic flow.

11. The crosswalk warning light system of claim 8 wherein said second light source is positioned in spaced relation from the crosswalk such that said second portion of said visual indication is projected into the crosswalk in the direction of traffic flow.

12. The crosswalk warning light system of claim 8 wherein said first light source is positioned directly above said crosswalk.

13. The crosswalk warning light system of claim 8 wherein each of said first light source and said second light source is a scanning laser.

14. The crosswalk warning light system of claim 8 wherein each of said first light source and said second light source is a focused strobe light.

15. A crosswalk warning light system for giving visual indication to motor traffic on a selected road that at least one pedestrian is within a crosswalk crossing the selected road by illuminating the crosswalk and objects therein, the crosswalk terminating at first and second ends on either side of the road and defining first and second side boundaries, said crosswalk warning light system comprising:

a power supply;

at least one light source vertically spaced from the ground for illuminating at least an area defined by the crosswalk with said visual indication;

at least one light support for supporting said light source above the crosswalk;

at least one sensor for detecting a pedestrian entering the crosswalk at either of the first and second ends of the crosswalk; and a controller for activating and deactivating said light source, said controller activating said light source upon detection by said sensor of the pedestrian entering the crosswalk.

16. The crosswalk warning light system of claim 15 wherein each of said at least one light source is positioned in spaced relation from the crosswalk such that said visual indication is projected into the crosswalk in the direction of traffic flow.

17. The crosswalk warning light system of claim 15 wherein each of said at least one light source is positioned directly above said crosswalk.

18. The crosswalk warning light system of claim 15 wherein each of said at least one light source is a scanning laser.

19. The crosswalk warning light system of claim 15 wherein each of said at least one light source is a focused strobe light.

* * * * *